US009373316B2

(12) United States Patent
Karapatis et al.

(10) Patent No.: US 9,373,316 B2
(45) Date of Patent: Jun. 21, 2016

(54) VIBRATION PLATE FOR A MUSIC BOX

(71) Applicant: Montres Breguet S.A., L'Abbaye (CH)

(72) Inventors: Polychronis Nakis Karapatis, Premier (CH); Younes Kadmiri, Morre (FR); Davide Sarchi, Renens (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/870,747

(22) Filed: Sep. 30, 2015

(65) Prior Publication Data

US 2016/0098981 A1 Apr. 7, 2016

(30) Foreign Application Priority Data

Oct. 3, 2014 (EP) ..... 14187634

(51) Int. Cl.
*G10D 1/06* (2006.01)
*G10K 1/10* (2006.01)

(52) U.S. Cl.
CPC ... *G10K 1/10* (2013.01); *G10D 1/06* (2013.01)

(58) Field of Classification Search
CPC ..... G10F 1/06
See application file for complete search history.

(56) References Cited

U.S. PATENT DOCUMENTS 266,826 A * 10/1882 Jeanrenaud ..... G10F 1/06 84/95.1
346,757 A * 8/1886 Lochmann ..... G10F 1/06 84/97
593,761 A * 11/1897 Brachhausen ..... G10F 1/06 84/94.1
5,955,687 A 9/1999 Miyagi et al.
2003/0183063 A1 10/2003 Muramatsu
2012/0140602 A1 6/2012 Favre et al.

FOREIGN PATENT DOCUMENTS

EP 2 461 220 A1 6/2012

OTHER PUBLICATIONS

European Search Report issued Apr. 2, 2015 in European Application 14187634.2, filed on Oct. 3, 2014 (with English translation).

* cited by examiner

*Primary Examiner* — Robert W Horn
(74) *Attorney, Agent, or Firm* — Oblon, McClelland, Maier & Neustadt, L.L.P.

(57) ABSTRACT

The invention relates to a vibration plate for a striking mechanism of musical watches or music boxes. According to the invention, the vibration plate includes at least two parts, joined to each other, manufactured in at least two materials, a first part forming a first set of strips made of a first material so as to produce sounds in a first frequency range, and at least a second part forming a second set of strips made of a second material so as to produce sounds in a second frequency range.

17 Claims, 2 Drawing Sheets

VIBRATION PLATE FOR A MUSIC BOX

This application claims priority from European Patent Application No. 14187634.2 filed on Oct. 3, 2014, the entire disclosure of which is hereby incorporated herein by reference.

FIELD OF THE INVENTION

The invention relates to the field of musical watches and music boxes of small dimensions.

BACKGROUND OF THE INVENTION

Generally, the striking mechanism of music boxes is formed by a vibration plate provided with several strips and a system of activating the strips of the vibration plate; the activation system may take the form of a rotating cylinder or a rotating disc. To fit a watch with such a striking mechanism, it is necessary to reduce the size of the components while taking into account their mechanical strength and while retaining a good sound quality.

Currently, the material of the vibration plate is selected mainly on the basis of manufacturability and resistance to wear and fatigue. Indeed, the strips of the vibration plate are subjected to repeated elastic forces and must therefore be quite resistant in order to have an acceptable lifetime.

Activation energy criteria for the strips must also be taken into account during manufacture of the vibration plate strips. It is known that the shortest strips require higher activation energy than long strips. Short strips are thus subjected to greater elastic forces and must have better resistance to wear and fatigue.

The vibration plates of current striking watches thus have a major drawback since a single material is used to manufacture the vibration plate strips, which means that manufacturers must make a compromise in the selection of material to make strips with acceptable vibration performance for both short strips and long strips. Such a compromise cannot thus achieve optimum results for the reproduction of high and low pitched sounds.

SUMMARY OF THE INVENTION

It is an object of the present invention to overcome all or part of the aforecited drawbacks by providing a vibration plate which simultaneously answers constraints of mechanical strength and vibration performance regardless of the length of the strips.

It is also an object of the invention to provide a vibration plate that matches the acoustic level of high and low pitched notes.

It is also an object of the invention, at least in one particular embodiment, to propose a vibration plate that can limit the wear and deformation of the strips.

It is also an object of the invention to provide a compact vibration plate.

Yet another object of the invention is to provide a vibration plate of simple design that is economical to manufacture.

To this end, the invention relates to a vibration plate including at least two parts, joined to each other, a first part forming a first set of strips made of a first material to produce sounds in a first frequency range, and at least a second part forming a second set of strips made of a second material to produce sounds in a second frequency range.

As a result of these features, this bi-material vibration plate makes it possible to select a material that is suitable as a function of mechanical strength for the strips reproducing the sounds of a first frequency range, typically high pitched sounds, and on the other hand, to select a material suitable as a function of the required activation energy for the strips reproducing the sounds of a second frequency range, typically low pitched sounds. There is thus obtained a vibration plate which exhibits optimum performance for the reproduction of sounds over the desired frequency range or ranges of the vibration plate.

In accordance with other advantageous variants of the invention:

- the first material has a Young's modulus of between 150 GPa and 250 GPa, a density of between 4000 kg/m$^3$ and 10000 kg/m$^3$, a hardness of more than 300 HV, and a tensile strength above 800 MPA, which makes it possible to have a more resistant material;
- the second material has a Young's modulus of between 70 GPa and 120 GPa, a density of between 14000 kg/m$^3$ and 20000 kg/m$^3$, a hardness of less than 300 HV, and a tensile strength of less than 600 MPA, which makes it possible to have a material with higher activation energy;
- the speed of sound in the second material is at least 40% lower than the speed of sound in the first material to limit the vibration transfer between the two parts;
- the first part and the second part are joined to each other so as to obtain a one-piece vibration plate by means of a soldering, brazing or press fit operation, so as to optimise the vibration transfer between the vibration plate and the radiating components;
- the vibration plate includes at least three parts, called the first part, second part and third part;
- the first part is manufactured in a first material, the second part is manufactured in a second material, and the third part is manufactured in a third material, the speeds of sound in the three materials being different from each other by at least 30% so as to limit the vibration transfer between the two parts;
- the first material is steel or metallic glass, the second material is gold or cast iron, and the third material is platinum, brass, aluminium, metallized sapphire, Phynox or cupronickel;
- the activation energy of each of the strips is greater than or equal to 20 microwatts so as to obtain efficient radiation.

The invention also concerns a music box including a musical module provided with at least one vibration plate according to the invention and with an activation assembly for activating the strips to produce music.

The invention also concerns a musical watch including a musical module provided with at least one vibration plate according to the invention and with an activation assembly for activating the strips to produce music.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
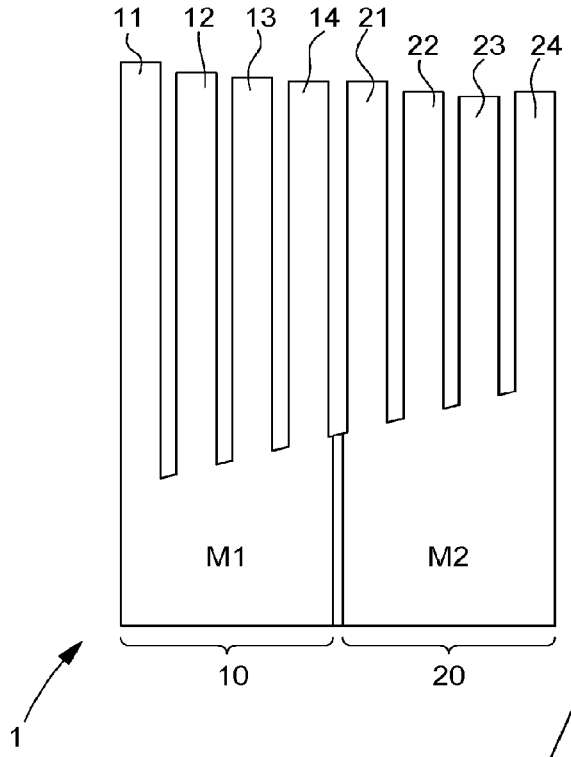
FIG. 1 is a top view of a vibration plate conforming to the invention according to a first embodiment.

A vibration plate for a music box of small size will now be described below with reference jointly to FIGS. 1, 2, 3, 4*a* and 4*b*.

The invention concerns a vibration plate 1 including at least two parts, joined to each other, manufactured in at least two materials, a first part 10 forming a first set of strips 11, 12, 13, 14 made of a first material M1 so as to produce sounds in a first frequency range, and at least a second part 20 forming a second set of strips 21, 22, 23, 24 made of a second material M2 so as to produce sounds in a second frequency range.

The first frequency range may, for example, extend from 1600 Hz to 20 kHz, which makes it possible to reproduce high pitched sounds. The second frequency range may extend from 20 Hz to 400 Hz which makes it possible to reproduce low pitched sounds. It is also possible to consider the frequency range extending from 400 Hz to 1600 Hz in order to reproduce medium pitched sounds.

According to the invention, the first material M1 has a Young's modulus of between 150 Gpa and 250 Gpa, a density of between 4000 kg/m$^3$ and 10000 kg/m$^3$, a hardness of more than 300 HV and a tensile strength above 800 MPa.

An example of a material meeting these criteria is steel. Such a material can make the strips reproducing high pitched sounds mechanically stronger. Obviously, any other material meeting these criteria may be used to make the first set of strips 11, 12, 13, 14.

The second material M2 has a Young's modulus of between 70 Gpa and 120 Gpa, a density of between 14000 kg/m$^3$ and 20000 kg/m$^3$, a hardness of less than 300 HV and a tensile strength of less than 600 MPa.

An example of a material meeting these criteria is gold. Such a material makes it possible for the strips producing low pitched sounds to store a quantity of energy greater than or equal to 20 microwatts when activated. Obviously, any other material meeting these criteria may be used to make the second set of strips 21, 22, 23, 24.

According to a particularly advantageous aspect, the use of two different materials to reproduce the low pitched notes and the high pitched notes makes it possible to select the material so that the activation energy of the strips producing the high pitched notes and low pitched notes is relative close.

According to the invention, the speed of sound in second material M2 is at least 40% lower than the speed of sound in first material M1 so as to limit the vibration transfer between first part 10 and second part 20.

According to the invention, first part 10 and second part 20 are joined to each other so as to obtain a one-piece vibration plate by means of a soldering, brazing or press fit operation, or any other method known to those skilled in the art for producing a one-piece part.

Joining the two parts 10, 20 makes it possible, in particular, to obtain correct positioning with respect to the activation member, such as a disc or a cylinder. Joining the two parts also makes it possible to optimise the vibration transfer between the vibration plate and the radiating components of a music box or of a musical watch.

According to a particular embodiment of the invention, the vibration plate may include a first part 10, a second part 20 and a third part 30 able to form a third set of strips 31, 32, with each part being able to be made of a separate material. Obviously, those skilled in the art could vary the number of parts of vibration plate 1 to obtain the desired result without departing from the scope of the present invention.

According to a first example given merely by way of non-limiting illustration, the first part 10 and second part 20 are made of material M1 and are connected to each other by means of third part 30 made of material M2. According to this embodiment, the third part 30 is sandwiched between first part 10 and second part 20.

According to another example, first part 10 and second part 20 are made of material M2 and are connected to each other by means of third part 30 made of material M1. Third part 30 is also sandwiched between first part 10 and second part 20.

Figure 4A:
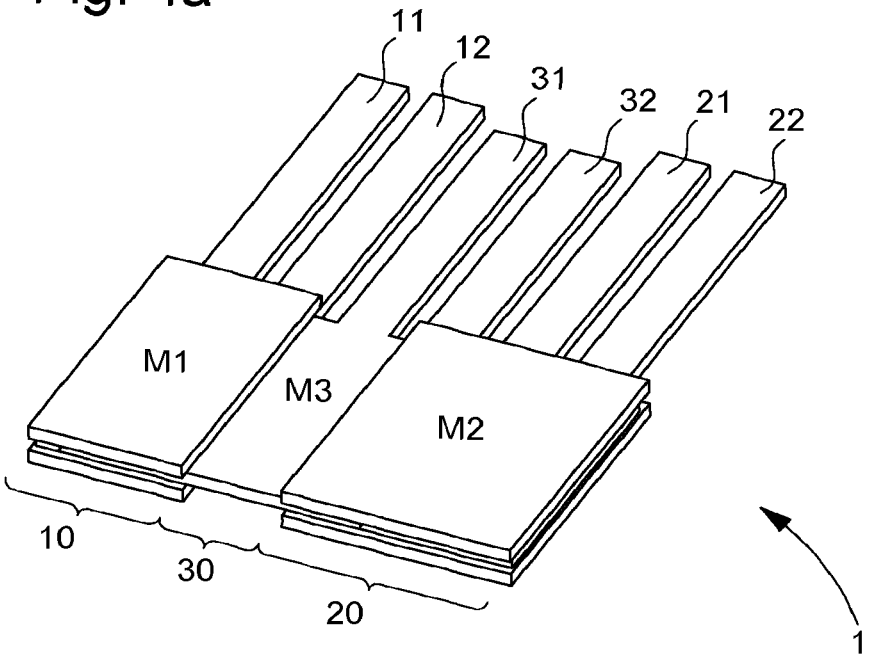
FIGS. 4*a* and 4*b* are perspective views of a vibration plate conforming to the invention according to another embodiment.
Figure 4B:
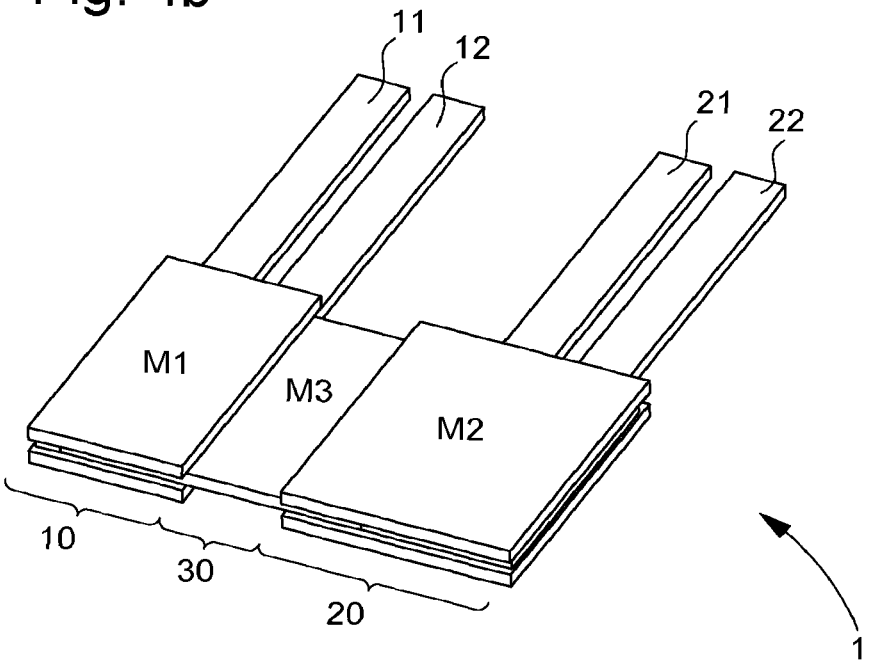

According to yet another example, illustrated in FIGS. 4*a* and 4*b*, first part 10 is made of a first material M1, second part 20 is made of a second material M2, and third part 30 is made of a third material M3.

According to a particularly advantageous aspect of the invention, the speeds of sound in the three materials M1, M2 and M3 differ from each other by at least 30% so as to limit the vibration transfer between the two parts. This embodiment makes it possible to produce a vibration plate in three parts, each of the parts being able to reproduce sounds in a distinct frequency range.

Advantageously, the third material M3 used for making third part 30 is selected so as to limit, or even prevent, the transfer of vibrations between neighbouring strips of the first and second parts 10, 20.

According to an embodiment of the invention, visible in FIG. 3*a*, the third part 30 forming the link between first part 10 and second part 20 may have strips 31, 32 so as to reproduce additional sounds. According to another embodiment, visible in FIG. 4*b*, third part 30 may have no strips and simply act as a connecting element between first part 10 and second part 20.

According to the invention, the first material M1 may be one of the following materials: steel, titanium, metallic glass, bronze or magnesium. The second material M2 may be one of the following materials: gold, cast iron or palladium. The third material M3 may be one of the following materials: platinum, brass, aluminium, metallized sapphire, Phynox or Arcap.

For example, the first part 10 may be made of gold, second part 20 of steel and third part 30 of brass. Those skilled in the art may of course make any combination they wish to obtain the desired result without thereby departing from the scope of the present invention.

Each strip of each of parts 10, 20, 30 may be of rectilinear shape with a rectangular or circular or other cross section, which may be identical over the entire length of the strip. The cross section may also vary gradually or discontinuously along the length of each strip. The length and thickness of each strip may also be of different dimensions to produce different notes. Each of the strips of each of parts 10, 20 and 30 may have a different width.

Each strip of vibration plate 1 is dimensioned generally to produce a different note for each strip, when the strip is activated by a specific activation member of a musical module. However, it is also possible to have a pair of strips that are capable of producing the same particular note.

Figure 2:
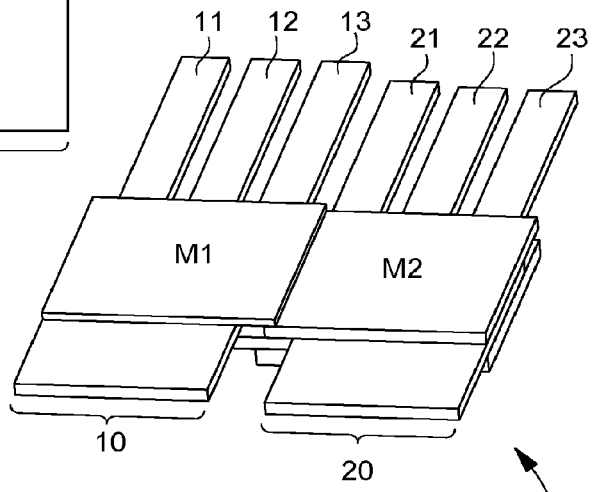
FIG. 2 is a perspective view of a vibration plate conforming to the invention according to a second embodiment.
Figure 3:
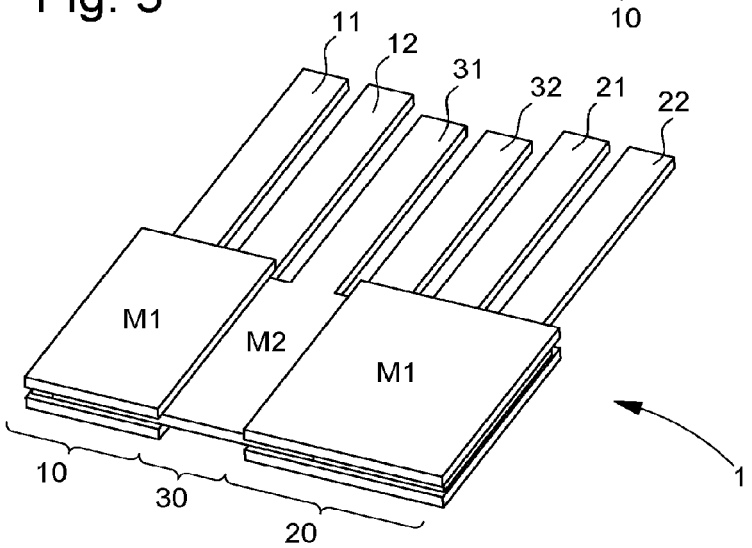
FIG. 3 is a perspective view of a vibration plate conforming to the invention according to a third embodiment.

As can be observed in FIGS. 1 to 3, the number of strips may vary in each of parts 10, 20, 30. Each part 10, 20, 30 of vibration plate 1 may include an even or odd number of strips according to the requirements of those skilled in the art to form vibration plate 1 and to reproduce the desired notes.

The invention also concerns a music box including a musical module provided with at least one vibration plate 1 according to the invention and with an activation assembly, such as a disc or a cylinder fitted with lugs, for activating the strip to produce music.

The invention also concerns a musical watch equipped with a musical module provided with at least one vibration plate 1 according to the invention and with an activation assembly, such as a disc or cylinder fitted with lugs, for activating the strips to produce music.

Owing to these different aspects of the invention, there is obtained a vibration plate of simple design, making it possible to match the acoustic level of high and low notes, and enjoying good mechanical strength and good vibration efficiency.

Of course, the present invention is not limited to the illustrated example and is capable of various variants and modifications that will appear to those skilled in the art.

LIST OF PARTS

1. Vibration plate,
10. First part of the vibration plate,
11, 12, 13. Strips of the first part
20. Second part of the vibration plate,
21, 22, 23. Strips of the second part,
30. Third part of the vibration plate,
31, 32. Strips of the third part,
M1. First material,
M2. Second material
M3. Third material.

What is claimed is:

1. A vibration plate for a striking mechanism of a musical watch or music box, wherein the vibration plate includes
- at least two parts, joined to each other, manufactured in at least two materials,
  - a first part forming a first set of strips made of a first material so as to produce sounds in a first frequency range, and
  - at least a second part forming a second set of strips made of a second material so as to produce sounds in a second frequency range.

2. The vibration plate according to claim 1, wherein the first material has a Young's modulus of between 150 GPa and 250 GPa.

3. The vibration plate according to claim 1, wherein the first material has a density of between 4000 kg/m$^3$ and 10000 kg/m$^3$.

4. The vibration plate according to claim 1, wherein the first material has a hardness of more than 300 HV.

5. The vibration plate according to claim 1, wherein the first material has a tensile strength above 800 MPa.

6. The vibration plate according to claim 1, wherein the second material has a Young's modulus of between 70 GPa and 120 GPa.

7. The vibration plate according to claim 1, wherein the second material has a density of between 14000 kg/m$^3$ and 20000 kg/m$^3$.

8. The vibration plate according to claim 1, wherein the second material has a hardness of less than 300 HV.

9. The vibration plate according to claim 1, wherein the second material has a tensile strength of less than 600 MPa.

10. The vibration plate according to claim 1, wherein the speed of sound in the second material is at least 40% lower than the speed of sound in the first material.

11. The vibration plate according to claim 1, wherein the first part and the second part are joined to each other so as to obtain a one-piece vibration plate by means of a soldering, brazing or press fit operation.

12. The vibration plate according to claim 1, including at least three parts, called the first part, second part and third part.

13. The vibration plate according to claim 12, wherein the first part is manufactured in a first material, the second part is manufactured in a second material, and the third part is manufactured in a third material, the speeds of sound in the three materials being different from each other by at least 30%.

14. The vibration plate according to claim 13, wherein the first material is steel or metallic glass, the second material is gold or cast iron, and the third material is platinum, brass, aluminium, metallized sapphire, Phynox or cupronickel.

15. The vibration plate according to claim 1, wherein the activation energy of each of the strips is greater than or equal to 20 microwatts.

16. A music box including a musical module provided with at least one vibration plate according to claim 1 and with an activation assembly for activating the strips to produce music.

17. A musical watch including a musical module provided with at least one vibration plate according to claim 1 and with an activation assembly for activating the strips to produce music.

* * * * *